United States Patent [19]

Maruta et al.

[11] Patent Number: 4,907,033

[45] Date of Patent: Mar. 6, 1990

[54] COPYING APPARATUS HAVING FUNCTION OF ERASING UNNECESSARY IMAGE FROM BINDING MARGIN

[75] Inventors: Syuzi Maruta, Toyokawa; Masazumi Ito, Toyohashi, both of Japan

[73] Assignee: Minolta Camera Kabushiki Kaisha, Osaka, Japan

[21] Appl. No.: 136,361

[22] Filed: Dec. 22, 1987

[30] Foreign Application Priority Data

Dec. 27, 1986 [JP] Japan ..... 61-311183

[51] Int. Cl.[4] ..... G03G 15/00

[52] U.S. Cl. ..... 355/320; 355/319; 355/218

[58] Field of Search ..... 355/7, 23, 24, 218, 355/318, 319, 320

[56] References Cited

U.S. PATENT DOCUMENTS 4,187,024 2/1980 Satomi et al. .
4,582,417 4/1986 Yagasaki et al. .
4,611,908 9/1986 Buch ..... 355/218 X
4,653,899 3/1987 Watanabe .
4,674,864 6/1987 Stakenborg et al. ..... 355/218
4,674,866 6/1987 Tanaka .
4,699,365 10/1987 Smith et al. .
4,733,266 3/1988 Watanabe ..... 355/218 X
4,752,809 6/1988 Ito ..... 355/14 R

FOREIGN PATENT DOCUMENTS 0011872 1/1987 Japan .

*Primary Examiner*—A. C. Prescott
*Assistant Examiner*—Barry Shapiro
*Attorney, Agent, or Firm*—Burns, Doane, Swecker & Mathis

[57] ABSTRACT

The copying apparatus of the present invention comprises an exposure station for exposing an original to light; automatic document feeder for positioning the first surface of the original and turning the original upside down after an exposure; a photosensitive drum; a charger for sensitizing the photosensitive drum; an optical system for projecting the image of the original onto the sensitized photosensitive drum, an erasing unit for irradiating the sensitized photosensitive member with an erasing light and a controller for controlling the erasing unit to erase the images corresponding to binding margins of the first and second surfaces of the original.

9 Claims, 21 Drawing Sheets

COPYING APPARATUS HAVING FUNCTION OF ERASING UNNECESSARY IMAGE FROM BINDING MARGIN

BACKGROUND OF THE INVENTION

1. Field of the Invention

The present invention relates to a copying machine having the function of erasing an unnecessary image from the binding margin of a document.

2. Description of the Prior Art

Copying machines have heretofore been proposed which have the edition function of copying a specified area only of a document. When such a copying machine is used for an original with its binding margin specified as an area undesired for copying, a copy can be obtained with the unnecessary image, for example, of the punch holes in the original erased from the binding margin.

Further copying machines have already been provided which have the function of feeding duplex (double-faced) original. These machines are so adapted that duplex originals are fed to the document support table in succession, with each surface of each original facing the table, to copy the image on every surface of the originals on copy paper.

The front surface of the original fed can be copied with the undesired image as of punch holes erased from the binding margin by the combination of the edition function and the duplex original feeding function. However, the binding margin of the rear surface of the duplex original, which is positioned on the same side of the original sheet as the binding margin of the front surface, is positioned in opposite relation with the latter margin on the document support table, so that the unnecessary image on the rear surface can not be erased.

Accordingly, the edition function and the duplex original feeding function, even if combined, still require manual replacement of the duplex original when copying both surfaces on different sheets of copy paper with the image on the binding margin erased from each surface.

SUMMARY OF THE INVENTION

The main object of the invention is to provide a copying apparatus capable of copying originals with the unnecessary image erased.

Another object of the invention is to provide a copying apparatus adapted to copy duplex originals with the unnecessary image erased from each binding margin.

Another object of the invention is to provide a copying apparatus adapted to copy duplex originals of different sizes with the unnecessary image also erased from each binding margin automatically.

To fulfill these objects, the present invention provides a copying apparatus which comprises an exposure station for exposing an original to light; transport means for positioning the first surface of the original in the exposure station with its one end set in position, turning the original upside down after an exposure and positioning the second surface of the original in the exposure station with the other end thereof set in position; means for copying the image of the original positioned in the exposure station; means for selecting a mode for erasing unnecessary images of the original; and means operable in the erasing mode for erasing an image in a first area of the first surface of the original when the first surface is copied and erasing an image in a second area, different from the first area, of the second surface of the original when the second surface is copied.

DESCRIPTION OF THE PREFERRED EMBODIMENT

Figure 1:
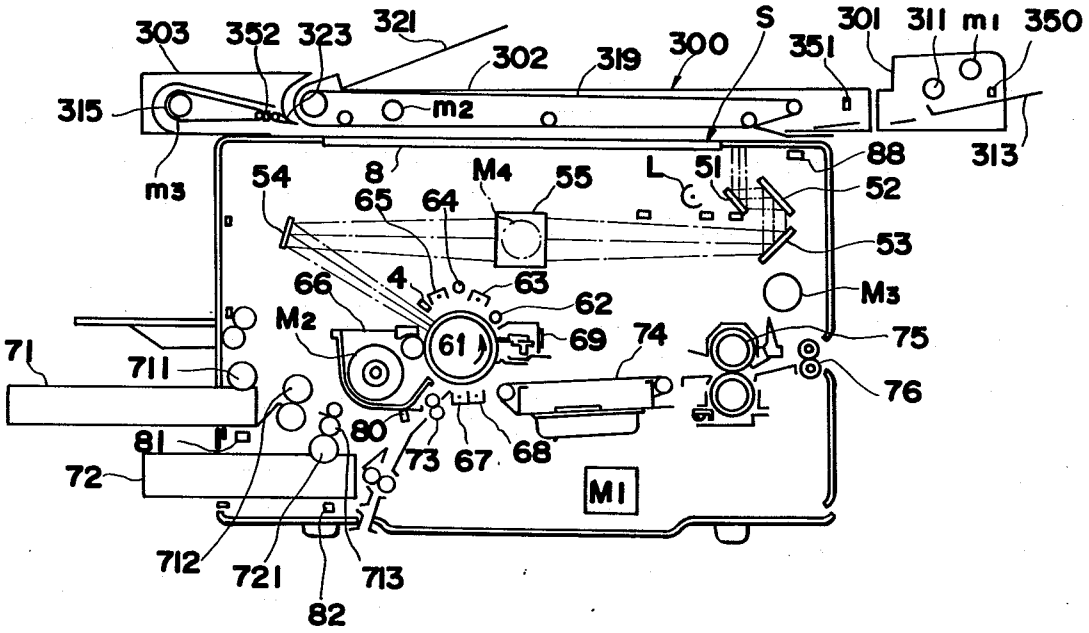
FIG. 1 is a sectional view schematically showing the construction of a copying apparatus of the invention.

Referring to FIG. 1, there is shown a copying machine embodying the present invention and equipped with a unit for feeding duplex original documents (hereinafter referred to as "ADF").

The copying machine comprises an original document support table 8 made of glass, an optical system 5 (51–55) for scanning an original document supported on the table 8 and projecting the scanned image onto a photosensitive drum 61, an image forming system 6 (4, 61–69) for forming a copy image of the original document on copy paper, and a paper feed-discharge system 7 (71–76, 711–721).

The optical system 5 includes a scanning assembly and a magnification setting assembly.

The former assembly, namely, the scanning assembly comprises a first carriage (not shown) carrying a light source L and a mirror 51, and a second carriage (not shown) carrying mirrors 52 and 53. The latter assembly, namely, the magnification setting assembly comprises a mirror 54 and an optical lens 55.

The first carriage and second carriage move along the lower surface of the table 8 to illuminate and scan the original document. The original image illuminated by the light source L is reflected from the mirrors 51, 52, 53, 54 toward the photosensitive drum 61 and is focused on the surface of the drum 61 by the lens (variable magnification lens block) 55. Both the first and the second carriages are driven together by a scanning motor M3. The moving velocity of the first carriage is V/N (V: peripheral velocity of photosensitive drum, N: copy magnification), and the velocity of the second carriage is V/2N in order to maintain the optical path at a constant length, while both the mirrors 54 and the lens 55 of the magnification setting assembly are driven together by another motor (stepping motor) M4. Specifically, the lens 55 is moved along the optical axis to vary the copy magnification, and the mirror 54 is pivotally moved to adjust the focal point on the photosensitive drum 61.

The image forming system 6, which comprises the photosensitive drum 61 drivingly rotatable in the direction of arrow shown, further includes as arranged around the drum 61 a main eraser lamp 62, subcharger 63, suberaser lamp 64, main charger 65, inter-image eraser unit 4, developing unit 66, transfer charger 67, copy paper separating charger 68 and a blade cleaner 69. The drum 61 has a photosensitive surface layer, which is sensitized when moving past the eraser lamps 62, 64 and the chargers 63, 65 and is subjected to a slit exposure by the optical system 5, whereby an electrostatic latent image is formed on the surface of the layer. No latent image is formed on the area from which the charge is removed by the eraser unit 4 before the exposure. A toner is deposited on the latent image by the developing unit 66 and is then transferred onto copy paper (fed by the paper feed-discharge system 7) by the transfer charger 67.

The paper feed-discharge system 7 comprises paper cassettes 71, 72, and feed rollers 711, 721 and pairs of transport rollers 712, 713 which are provided for the cassettes 71, 72, respectively. The system 7 further includes a pair of timing rollers 73, a conveyor belt 74, a fixing unit 75, a pair of discharge rollers 76, etc. These components are driven by a main motor M1. Disposed in the vicinity of the pair of timing rollers 73 is a sensor 80 for producing a signal for determining when to initiate the optical system 5 into scanning movement and when to turn on the eraser unit 4. Sensors 81, 82 are provided for the cassettes 71, 72, respectively, for detecting the size of paper contained therein.

The ADF 300 comprises a document support unit 301, a transport unit 302 and an inverting unit 303. The, support unit 301 has a sensor 350, feed motor M1 for driving a feed roller 311 for feeding an original document to the transport unit 302, and a document tray 313. The sensor 350 detects whether document sheets are present on the tray 313. The transport unit 302 has a conveyor belt 319 covering the document support table 8 for stopping the original document in position on the table 8, and a discharge tray 321. The conveyor belt 319 is driven by motor M2. The inverting unit 303 adapted for returning the original document to the transport unit 302 on inversion has a change guide 323 for effecting a change-over between a discharge path for delivering the original onto the discharge tray 321 and a transport path for guiding the original toward the inverting unit 303, and an inverting belt 315 for turning the original upside down. The unit 303 is used for duplex (double-faced) document sheets for turning the sheet upside down. The change guide 323 is driven by an unillustrated solenoid, while the inverting belt 315 is driven by motor M3. A sensor 351 is provided between the document support unit 301 and the conveyor belt 319, and a sensor 352 between the change guide 323 and the inverting unit 303. These sensors produce signals for controlling the transport of the document. The sensor 351 further detects the size of documents. The transport unit 302 is openably mounted on the main body of the copying machine so that documents can be set on the table 8 manually. The opening or closing of the unit 302 is detected by a sensor 88.

When a single-faced document sheet is to be copied, the ADF 300 feeds the sheet on the tray 313 onto the table 8 and positions the sheet with its rear end set in a specified position S on the table 8.

In the case of a duplex document sheet, the ADF 300 feeds the sheet from the tray 313 onto the table 8 with the front end of sheet as the leading end, turns the sheet upside down in the inverting unit 303 and thereafter positions the sheet on the table 8 with its front end set in position S. After an exposure, the ADF 300 inverts the sheet on the table 8 again in the unit 303 and then positions the sheet on the table 8 with its rear end set in position S.

Figure 2:
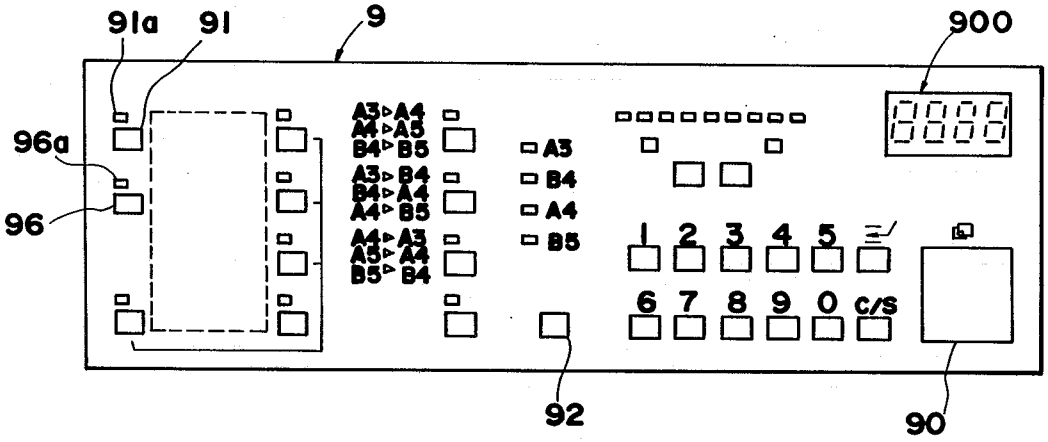
FIG. 2 is a top view showing the operation panel of the copying apparatus.

FIG. 2 is a plan view showing the operation panel 9 of the copying machine.

As illustrated, the panel 9 is provided with a print switch 90 for starting a copying operation, a duplex-single copy switch 91 for selecting a duplex-single copy mode in which the opposite surfaces of a duplex original document are copied on different sheets of copy paper, a binding margin erasure switch 96 for selecting a binding margin erasure mode, a copy paper selection key 92 for selecting one of the cassettes 71, 72, etc. containing copy paper, a display panel 900 for showing the number of copies or a magnification value, etc. Provided beside the switch 91 is an LED lamp 91*a* which goes on when the duplex-single copy mode is selected by the switch 91. Also provided beside the switch 96 is an LED lamp 96*a* which goes on when the margin erasure mode is selected by the switch 96.

Figure 3:
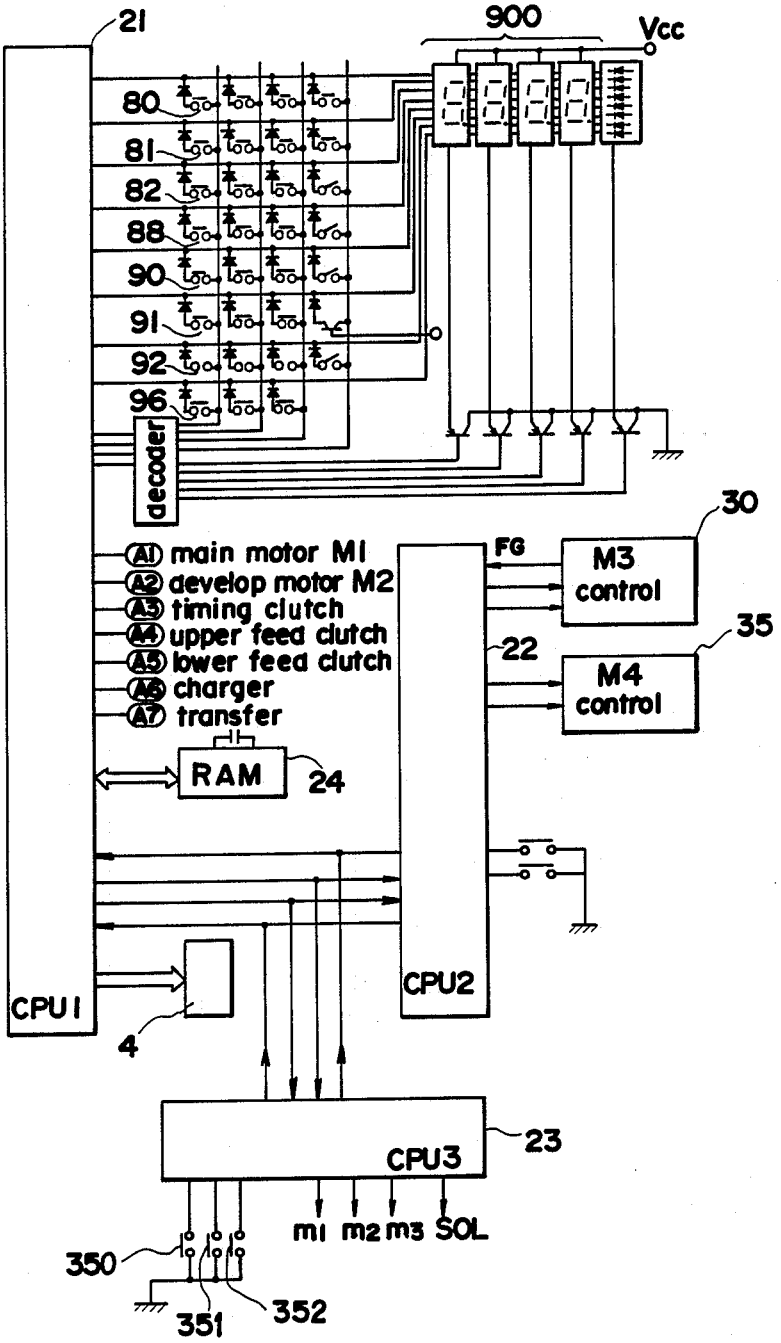
FIG. 3 is a block diagram showing the construction of the control system of the copying apparatus.

FIG. 3 is a diagram showing the control system of the copying machine.

As illustrated, the control system comprises a first CPU 21, second CPU 22, third CPU 23 and RAM 24.

The first CPU 21 controls the main operation of the copying machine including the operation of the image forming system 6 and of the paper feed-discharge system 7, the operation of the eraser unit 4 to be described later, the operation of the display panel 900 to display numerical values, temperature adjustment, etc.

The first CPU 21 has output terminals A1 to A7 which are connected to the main motor M1, developing motor M2, clutch for the timing roller pair 73, clutch for the feed roller 711, clutch for the feed roller 721, main charger 65 and transfer charger 67, respectively.

The second CPU 22 is connected to a drive circuit 30 for the scanning motor M3 and a drive circuit 35 for the stepping motor M4 and controls the operation of these motors M3, M4 in response to instructions from the first CPU 21.

The third CPU 23, which is adapted for controlling the operation of the ADF, has unillustrated input and output terminals, for example, for receiving input signals from the sensors 350, 351 and 352 and delivering drive output signals to a document feed motor m1, document conveyor belt motor m2, document inverting motor m3, solenoid SOL for operating the change guide, etc.

Figure 4:
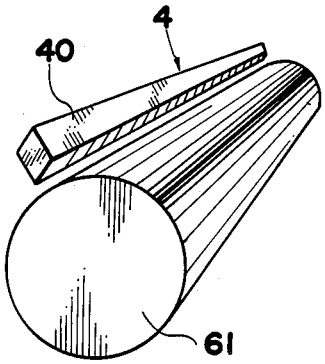
FIG. 4 is a diagram showing an eraser unit as positioned for a photosensitive drum.
Figure 5A:
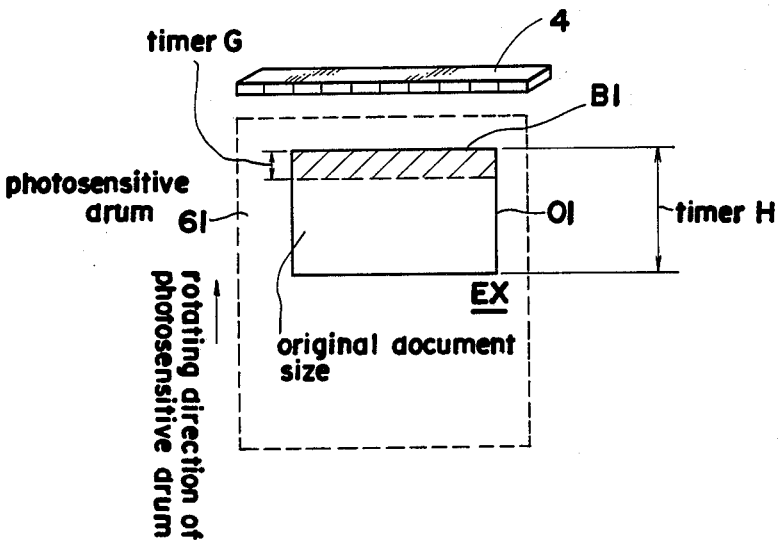
FIGS. 5(*a*) and 5(*b*) are diagrams for illustrating procedures for erasing unnecessary images in margins of an original.
Figure 5B:
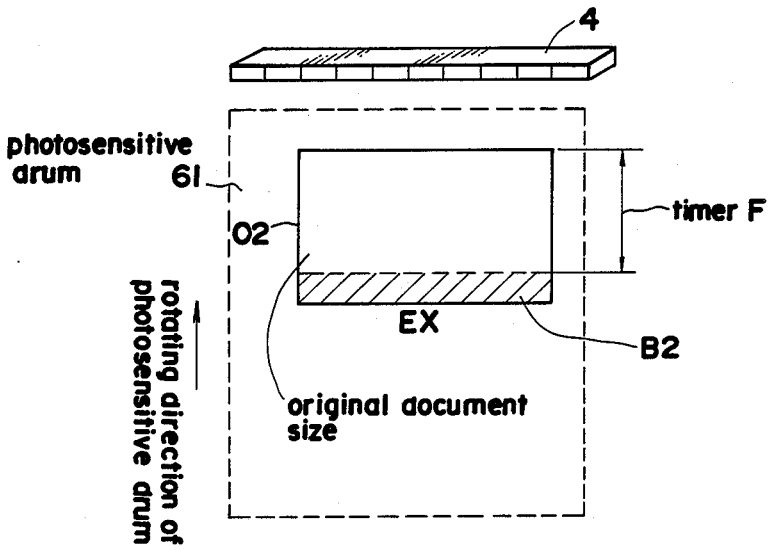

FIG. 4 is a perspective view showing the eraser unit 4 disposed in proximity to the photosensitive drum 61. FIGS. 5(*a*) and 5(*b*) are diagrams illustrating how to erase by the eraser unit 4 the charge from an area on the drum 61 in corresponding relation to the binding margin at the front or rear end of copy paper (with respect to the direction of feed of the paper) so as to erase the image in the margin.

As seen in FIG. 4, the eraser unit 4 has an array 40 of a multiplicity of LEDs arranged in a row. The LEDs, when turned on, remove the charge from the corresponding area on the drum 61 to preclude the formation of an electrostatic latent image on the area.

The procedure will be described with reference to FIGS. 5(*a*) and 5(*b*) for erasing the image on the binding margin of the original from the copy to be obtained, using the eraser unit 4.

First, when a single-faced document or the front surface of a duplex document is to be copied, a timer G is set to erase the portion B1, in the binding margin, of an original image 01, and a timer H is set to erase the charge from an area EX on the drum 61 downstream from the image 01 with respect to the direction of rotation of the drum, as shown in FIG. 5(*a*). During the operation of the timer G, all the LEDs of the unit 4 are turned on, removing the charge from the area B1 on the drum, whereby the image in the binding margin of the original to be otherwise reproduced is eliminated. On completion of the operation of the timer G, the eraser unit 4 is brought out of operation, permitting an image of the original other than the binding margin to be formed on the drum. Upon completion of the operation of the timer H, the LEDs of the unit 4 are all turned on again to erase the charge from the area EX.

Next, when the rear surface of the duplex original document is to be copied, a timer F is set to erase the portion B2, in the binding margin, of an original image 02. On completion of the operation of the timer F, all the LEDs of the eraser unit 4 are turned on, removing the charge from the area B2 on the drum, whereby the image of the original in the margin to be formed by copying is eliminated (see FIG. 5(*b*)). The LEDs of the eraser unit 4 are held on after the removal of charge from the area B2 of the drum, whereby the charge is removed from an area EX on the drum.

In this way, the original document can be copied without reproducing the image in its binding margin regardless of the kind of document (duplex or single-faced).

Figure 6:
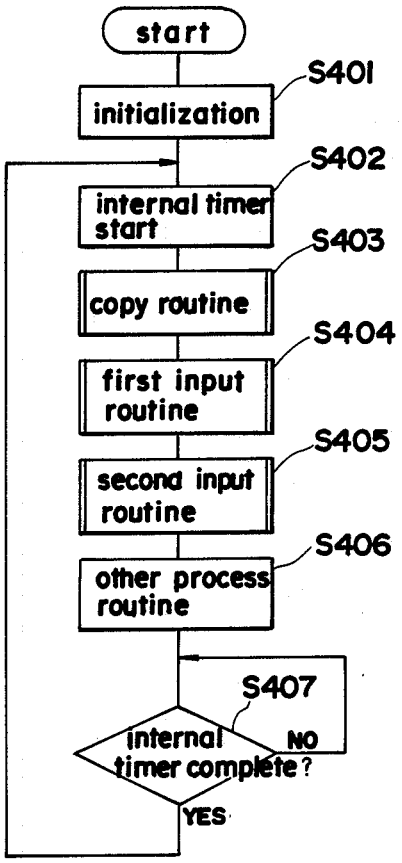
FIGS. 6 to 13 are flow charts showing the processing routines to be executed by a first CPU.
Figure 7:
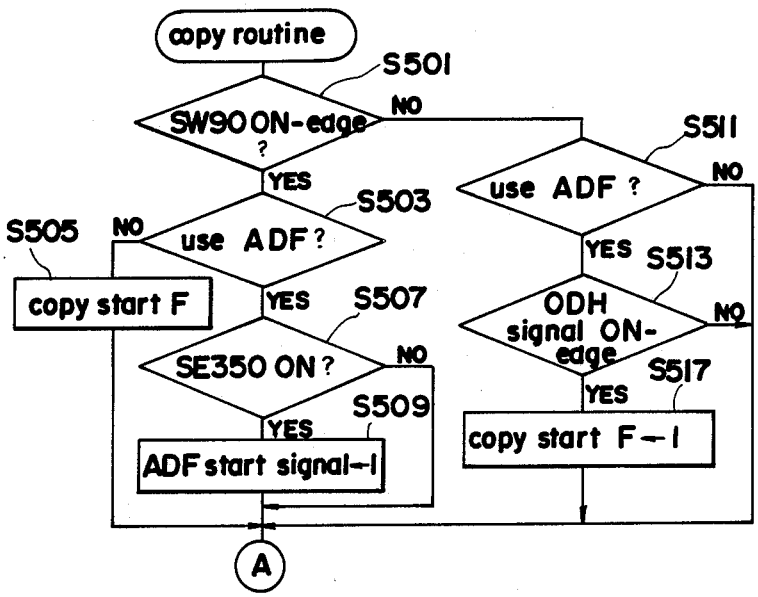
Figure 8:
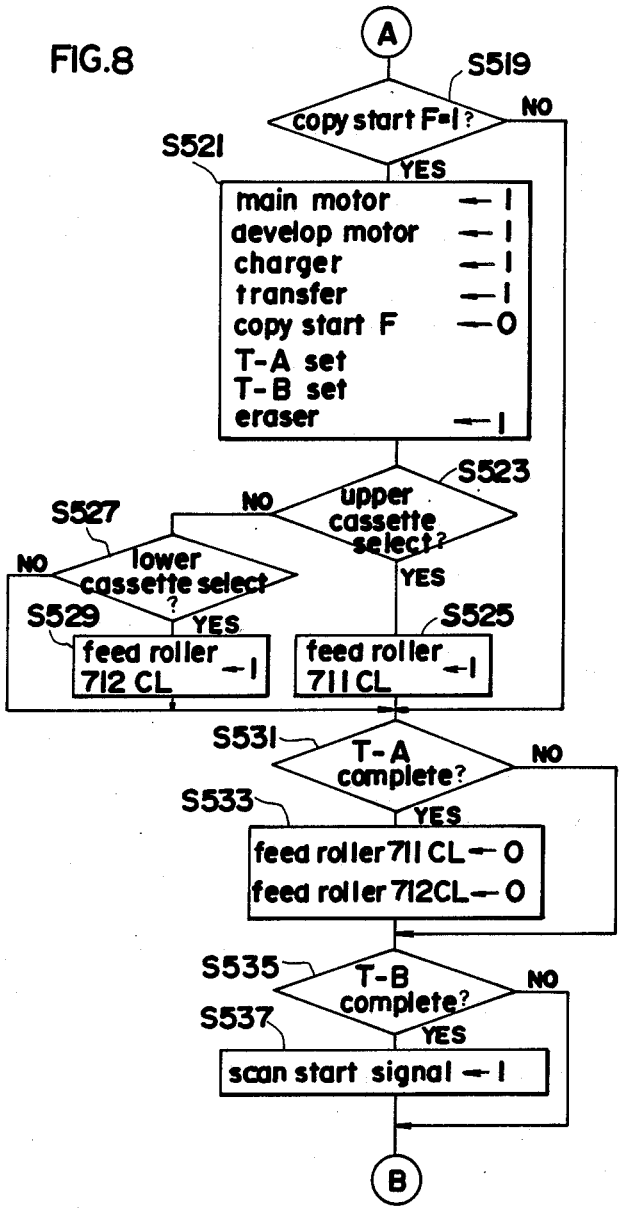
Figure 9:
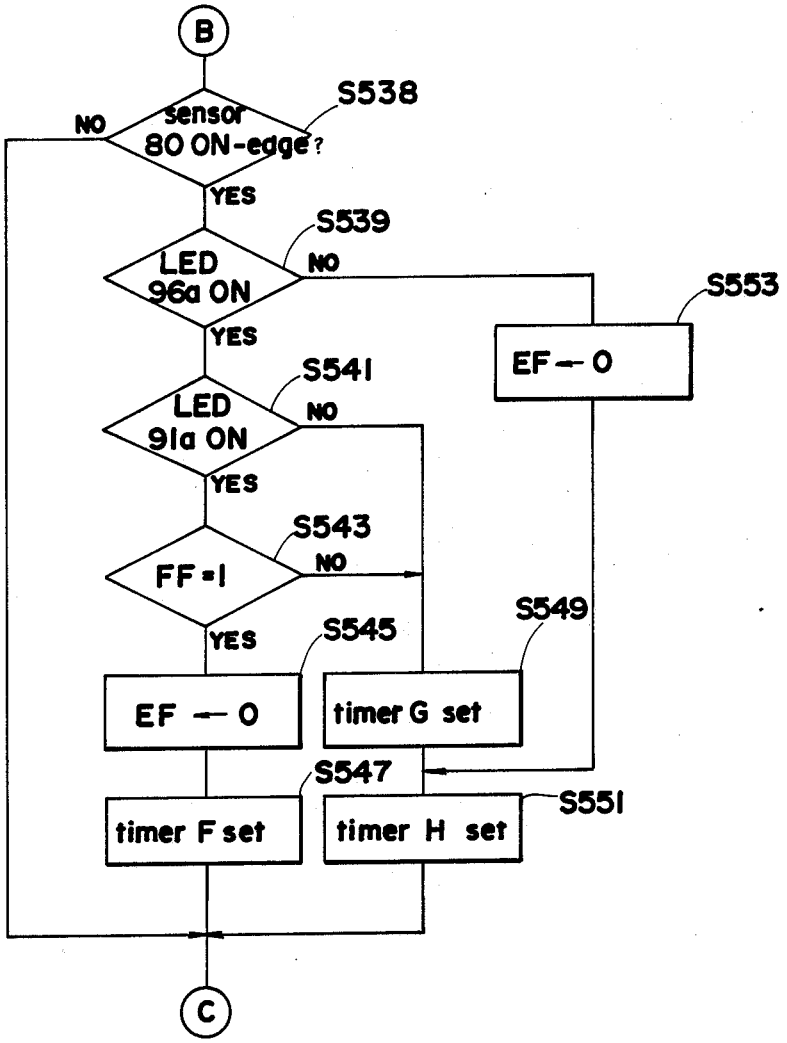
Figure 10:
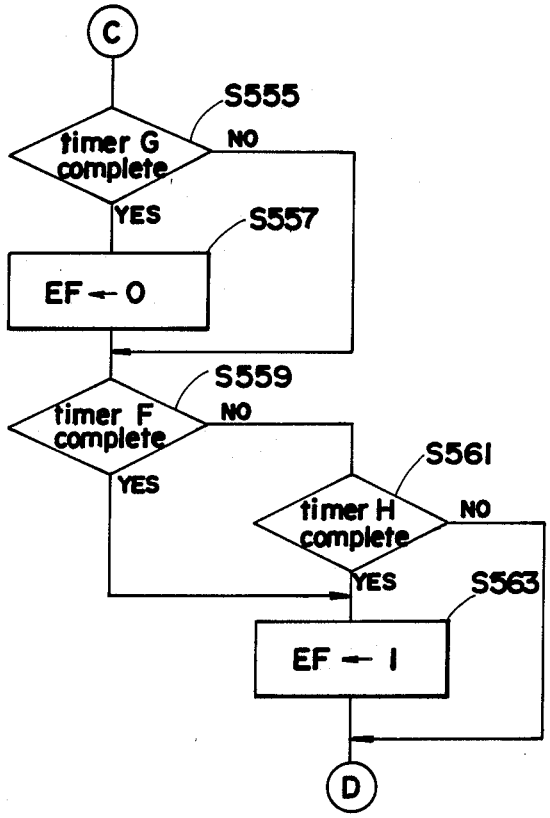
Figure 11:
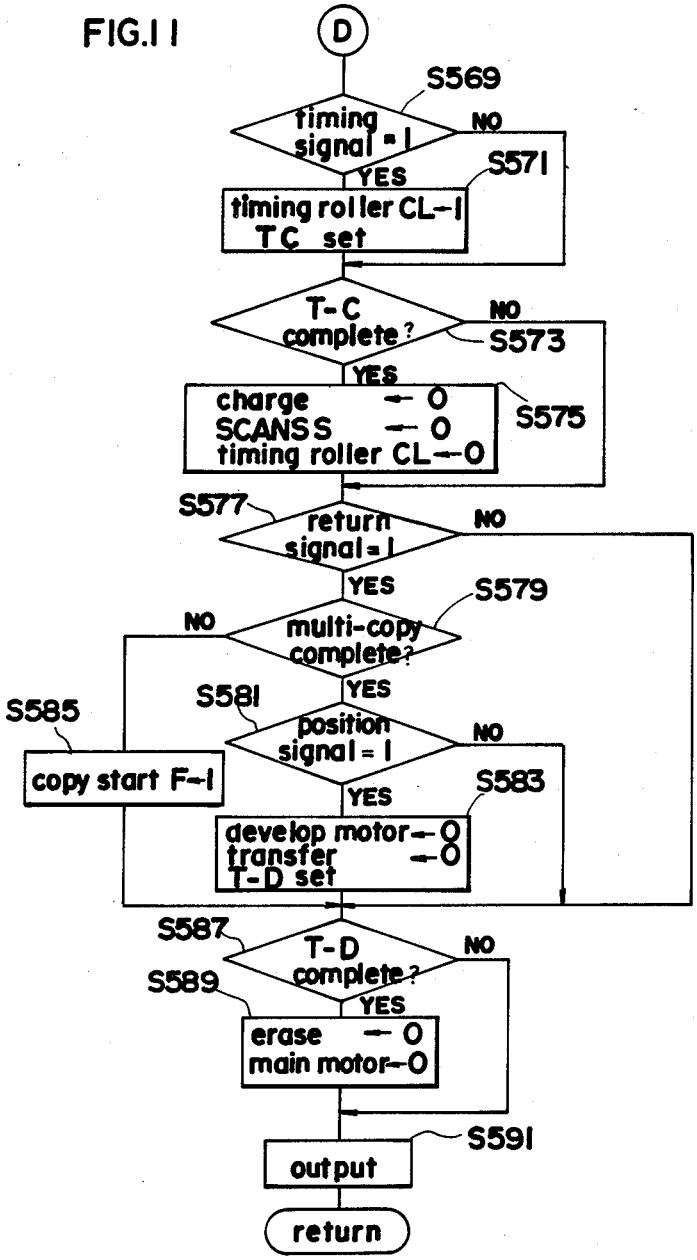

FIG. 6 is a flow chart generally showing the routines to be performed by the first CPU 21. The routine to be performed by the second CPU 22 is known and therefore will not be described.

When the power supply is turned on in step S401, the first CPU 21 starts its operation, initializing the machine first. More specifically, the RAM 24 and various internal registers are set to the initial states, and modes of the copying machine are set in the standard conditions (e.g., magnification 1.0X, number of copy 1).

Subsequently, the internal timer is started in step S402, and a copying operation processing routine is performed in step S403, which is then followed by step S404. In this step, a first input routine is performed for processing an input from the duplex-single copy mode switch 91. A second input routine is further performed in step S405 for processing an input from the binding margin erasure switch 96.

Subsequently, step S406 is executed for "other process routine" which includes receipt of various items of data (e.g. outputs from sensors detecting the operating state of various components),delivery of outputs to or communication with the other CPUs, feeding signals to the display panel or the fixing unit for the temperature control of its heat roller, etc.

After the completion of operation of the internal timer in step S407 following the above routine, the sequence returns to step S402 to repeat the loop of the above steps.

FIGS. 7 to 11 are flow charts showing the copying operation processing routine of step S403 in greater detail.

Before describing these flow charts, the terms "ON-edge" and "OFF-edge" will be defined. The term "ON-edge" means the change from OFF state to ON state in a switch, sensor, signal or the like. The term "OFF-edge" refers to the change from ON state to OFF state in a switch, sensor, signal or the like.

Steps S501 to S517 are performed upon the depression of the print switch 90 before the start of an actual copying operation.

First, step S405 inquires whether the print switch 90 has been depressed, i.e., whether the switch 90 is ON-edge. If it is ON-edge, step S503 checks whether the ADF 300 is in use from an output signal from the third CPU 23. When the ADF is not in use, a copy start flag is set to "1" in step S505. On the other hand, when the ADF is in use, the document tray 313 is checked for the presence of any document with reference to the state of the sensor 350 in step S507. If the sensor 350 is ON, indicating the presence of document, an ADF start signal is set to "1" in step S509.

If the print switch 90 is not ON-edge and further if step S511 detects that the ADF is in use, step S513 inquires whether ODH signal (i.e. a signal emitted when the original document has been transported to the specified position on the document support table 8) is ON-edge or not. When the inquiry is answered in the affirmative, the copy start flag is set to "1" in step S517.

Steps S519 to S537 show the control process to be executed before the start of scanning.

Step S519 checks the copy start flag. If it is "1" (S519), step S521 turns on the main motor M1, developing motor M2, subcharger 63, main charger 65, transfer charger 67 and all the LEDs of the eraser unit 4, sets timers TA and TB and further resets the copy start flag. The timer TA determines when to disengage the clutches of the feed rollers 711 and 721, while the timer TB determines scanning start time. The LEDs of the eraser unit 4 are turned on to prevent deposition of the toner on the area of the photosensitive drum 61 other than the latent image forming area thereof.

In the following steps S523 to S529, the clutch of the feed roller 711 or 721 for the selected one of the upper cassette 71 and the lower cassette 72 is engaged, starting to transport copy paper.

In step S531, the timer T-A is checked as to the completion of its operation, and the engaged clutch of the feed roller 711 or 721 is disengaged (S533) to stop the feed roller.

Step S535 then checks the timer T-B for the completion of its operation. If it has been completed, the scanning start signal (scan signal) to be sent to the second CPU 22 is set to "1" (S537).

Steps S538 to S551 are performed for a process for setting the timers F, G and H for determining control timing for the eraser unit 4.

Step S538 detects that the sensor 80 is ON-edge, indicating the arrival of the copy paper leading end at the position of the sensor 80, whereupon step S539 follows, which checks whether the binding margin erasure mode is selected with reference to the LED 96*a* (binding margin erasure mode display LED). If the mode is selected, step S541 inquires whether the duplex-single copy mode in which the opposite surfaces of a duplex original document are copied on different sheets of copy paper is selected, with reference to the LED 91*a* (for displaying this mode). When the mode is selected, step S543 checks a front surface flag FF. As will be described later, the flag FF becomes "1" when the rear surface of a duplex original document is copied, or "0" for copying the front surface.

When the flag FF is "1", an eraser flag EF is reset to "0" in step S545, turning off all LEDs of the eraser unit 4 so that an electrophotographic latent image can be formed first at the front end of the image forming area on the drum 61 with respect to the direction of rotation thereof. The timer F is set in step S547 for determining the time to turn on all the LEDs of the unit 4, so that no electrostatic latent image will be formed at the rear end of the image forming area of the drum 61 with respect to the rotational direction of the drum to preclude formation of any copy image at the rear end of the copy paper with respect to the paper feed direction, over an area corresponding to the binding margin.

On the other hand, if the front surface flag FF is "0" (S543), the timer G is set to determine when to hold all the LEDs of the eraser unit 4 for the front end of the image forming area on the drum 61 with respect to the rotational direction of the drum (S549), so that no latent image will be formed at the front end of this drum area to prevent formation of any copy image at the leading end of the copy paper over an area corresponding to the binding margin.

When the binding margin erasure mode is not selected (S539), the erasure flag EF is reset to "0", permitting formation of an electrostatic latent image on the image forming area (S553). The eraser-on timer H is set in step S551 for preventing deposition of the toner on the drum 61 except at the image forming area thereof.

Steps S555 to S563 control the eraser unit 4 for turning on and off based on the operation of the timers F, G and H set as above.

The timers F and H are set to values in accordance with the size of the document (with the size of copy paper for life-size copying). On the other hand, the timer G is set to a definite value irrespective of the document size. The timers F and G are set according to Table 1 below.

TABLE 1

| | Timer F | Timer G | Timer H |
|---|---|---|---|
| A4 widthwise | F0 | G0 | H0 (F0 + G0) |
| A4 lengthwise | $\frac{297}{210}$ F0 + $\frac{87}{210}$ G0 | G0 | $\frac{297}{210}$ H0 |
| B4 widthwise | $\frac{257}{210}$ F0 + $\frac{47}{210}$ G0 | G0 | $\frac{257}{210}$ H0 |
| B4 lengthwise | $\frac{364}{210}$ F0 + $\frac{154}{210}$ G0 | G0 | $\frac{364}{210}$ H0 |
| A3 lengthwise | 2F0 + G0 | G0 | 2H0 |

Table 1 shows the timer values for various sizes based on F0, G0 and H0 which are the values of the timers F, G and H, respectively, to be set for an original document of A4 size as set with its shorter side positioned in the same direction as the direction of rotation of the photosensitive drum (hereinafter referred to as "A4 widthwise").

Steps S555 to S563 will be described.

First, step S555 detects the completion of operation of the timer G, whereupon the eraser flag EF is reset to "0" to turn off all the LEDs of the eraser unit 4 in step S557. This step S557 is performed when the timer G is set, i.e., when the document to be copied is single-faced or when the front surface of a duplex document is to be copied in the binding margin erasure mode.

On the other hand, step S559 checks the timer F for the completion of its operation, and step S561 checks the timer H. When either one of the timers F and H has completed its operation, the eraser flag EF is set to "1" in step S563, turning on all LEDs of the eraser unit 4. The timer F is set when the rear surface of a duplex document is to be copied in the binding margin erasure mode. The timer H is set in any case except when the timer F is set.

Steps S569 to S591 are performed for the process from the start of scanning through the completion of copying operation.

First, step S569 checks a timing signal from the second CPU 22. When the timing signal is found to be "1", the clutch for the timing roller pair 73 is engaged in step S571, feeding the copy paper to a space between the drum 61 and the transfer charger 67 to start transferring the toner image onto the copy paper. In step S571, a timer T-C is set which determines the time to complete the scanning movement, to complete charging and to disengage the clutch for the timing roller 73 (S573 and S575). The time to be determined by the timer is dependent on the copy paper size selected by steps S523 to S529 and the magnification setting.

Subsequently, step S577 checks a return signal from the second CPU 22 as to whether it is "1". If it is so, return is started (S577), and multicopying operation is completed (S579). In response to a home position signal from the second CPU 22 (S581), the developing motor M2 and the transfer, charger 67 are turned off, while a timer T-D is set (S583). The timer TD acts to deenergize the main motor M1 and also to reset the eraser flag EF to "0" to turn off all the LEDs of the eraser unit 4 (S587 and S589).

If the multicopying operation has not been found completed in step S579, the copy start flag is set (S585) for another copying cycle.

Next in step S591, the aforementioned control signals are produced to control external devices and signals are forwarded to other CPUs.

In this way, the machine operates for copying.

Figure 12:
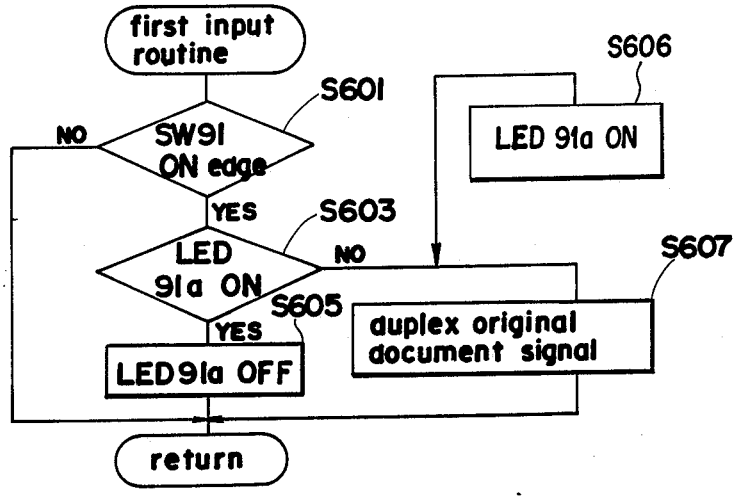

FIG. 12 is a flow chart showing the first input routine (S404) in detail. When the duplex-single face copy switch 91 is found to be ON-edge (S601), whether the duplex-single face copy mode has already been selected is detected from whether the LED 91*a* is on (S603). The lamp, if on, is turned off to cancel the mode (S605). If it is off, the lamp is turned on, and the duplex original document signal to be given to the third CPU 23 is set to "1".

Figure 13:
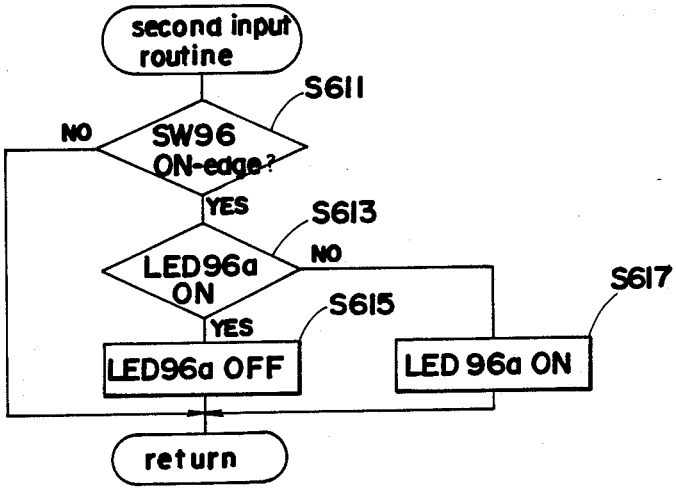

FIG. 13 is a flow chart showing the second input routine (S408) in detail. When the binding margin erasure switch 96 is found to be ON-edge (S611), whether the binding margin erasure mode has already been selected is detected from whether the LED 96*a* is on (S613). The light, if on, is turned off to cancel the mode (S615), whereas if it is off, the light is turned on (S617) to select the mode.

Figure 14:
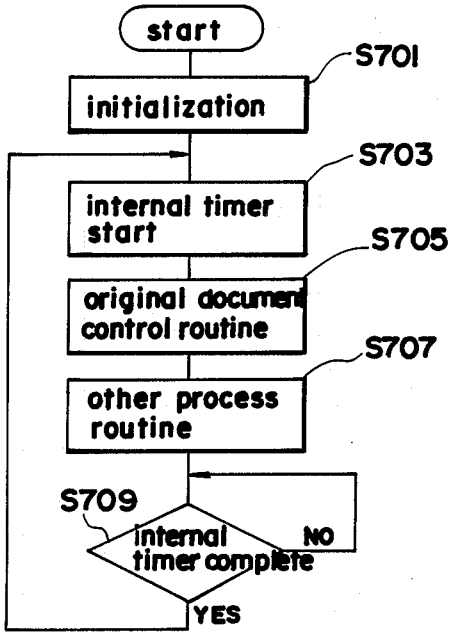
FIGS. 14 to 23 are flow charts showing the processing routines to be executed by a third CPU.
Figure 15:
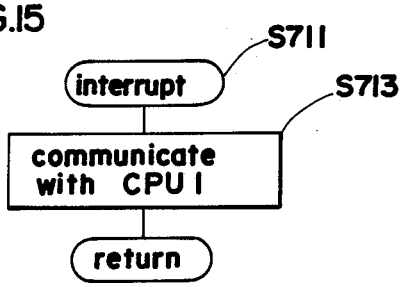

FIG. 14 is a flow chart generally showing the process to be executed by the third CPU 23 for controlling the ADF. The third CPU is initiated into this process by turning the power supply on. First, step S701 is performed for initialization. Next, an internal timer is started to determine one routine (S703), followed by an original document control routine (S705) and by other process routine (S707). On completion of the operation of the internal timer (S709) the routine returns to step S703. When there is an interruption from the first CPU as seen in FIG. 15, S711, the third CPU conducts a communication with the first CPU (S713).

Figure 16:
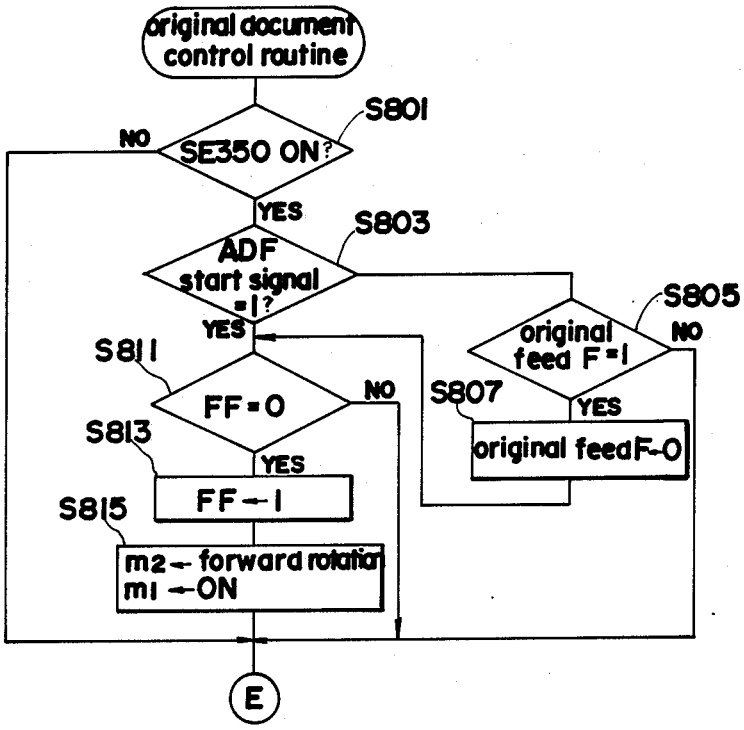
Figure 17:
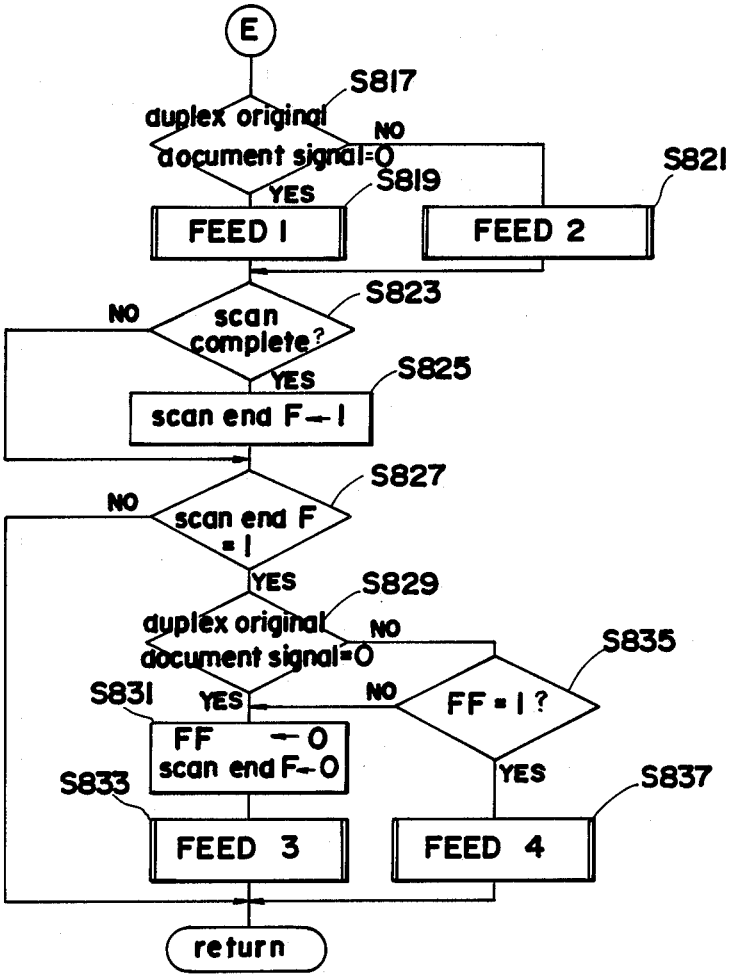

FIG. 16 is a flow chart showing the original document control routine (S705) in detail. First, the sensor 350 indicates whether any document is present in the document tray 313 (S801). When it is present, step S803 inquires whether the ADF start signal from the first CPU 21 is "1". If it is not "1", an original feed flag is checked as to whether it is "1" (S805). The original feed flag becomes "1" when the second original sheet is present on the tray 313 after the first original sheet has been completely copied (S903 in FIG. 21). The feed flag, when "1", is reset to "0", followed by step S811.

When the ADF start signal is "1", step S811 checks whether a front surface flag FF is "0". In the case where a duplex original signal is "1", the front surface flag FF is "1" when the first surface (rear surface) of the original is to be copied or is "0" when the second surface (front surface) thereof is to be copied. The term the "first surface" refers to the one surface of a duplex original which is to be copied first and which is the rear surface thereof with the greater page number than the other surface (e.g. page 2). The term the "second surface" refers to the other surface of the duplex original which is to be copied thereafter and which is the front surface thereof with the smaller page number (e.g. page 1).

The front surface flag FF, when "0", is changed to "1" (S813), followed by step S815 to forwardly rotate the motor m2 for driving the conveyor belt 319 and to energize the motor m1 to drive the document feed roller 311.

Next, the duplex original signal is checked as to whether it is "0" or "1" in step S817. As already stated, this signal becomes "1" for a duplex original document or "0" for a single-faced original document. When the signal is "0", the document feed routine FEED 1 to be described later is performed (S819). If the signal is "1", the document inversion feed routine FEED 2 to be described later is performed (S821).

When an output signal from the first CPU 21 subsequently indicates that the scanning movement for the desired number of copies has been completed, a scan end flag is set to "1", followed by an inquiry as to whether the duplex original signal is "0" (S823 to S829). This signal, when "0", indicates a single-faced original, so that the front surface flag FF is changed to "0" and the scan end flag to "0", followed by the document discharge routine FEED 3 to be described later (S831, S833). On the other hand, when the duplex original signal is "1" and also when the front surface flag FF is "1", indicating that the first surface (rear surface) of a duplex original is to be copied, the document inversion routine FEED 4 to be described later is performed (S837).

Figure 18:
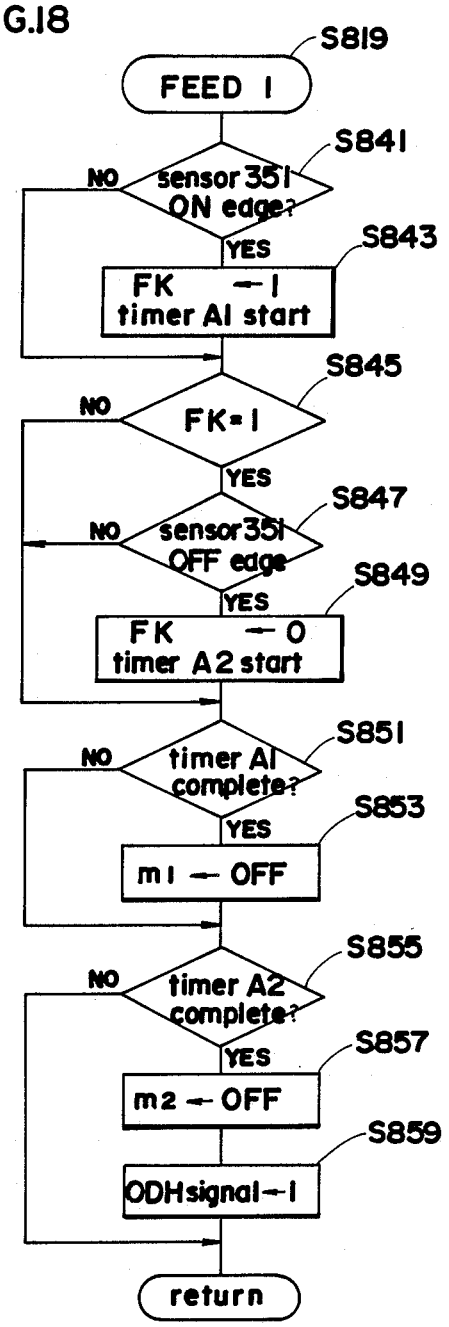

FIG. 18 is a flow chart showing the document feed routine FEED 1 (S819) in detail. When the sensor 351 is ON-edge, detecting the leading end of the original document (S841), a flag K is set to "1" to start a timer A1 (S843). On completion of the operation of this timer, the document feed motor m1 is deenergized (S851, S853). The timer A1 determines the time taken for the document to be transported by the document feed roller 311 to the position from which it is further transported by the conveyor belt 319. When the sensor 351 is OFF-edge, detecting the rear end of the document (S847), the flag K is reset to "0" and a timer A2 is started (S849). On completion of the timer operation (S855), the conveyor belt motor m2 is turned off, and the ODH signal for indicating that the document is in position is set to "1" (S859). The timer A2 provides the time required for the document rear end to reach the specified position (specified by a document scale) on the table 8 by being transported by the belt 319.

Figure 19:
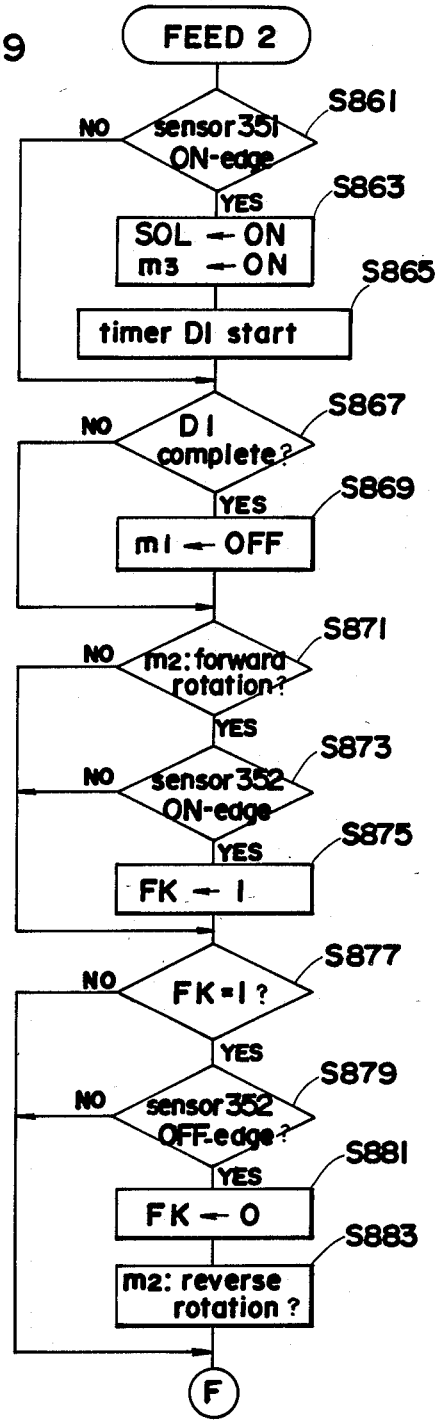
Figure 20:
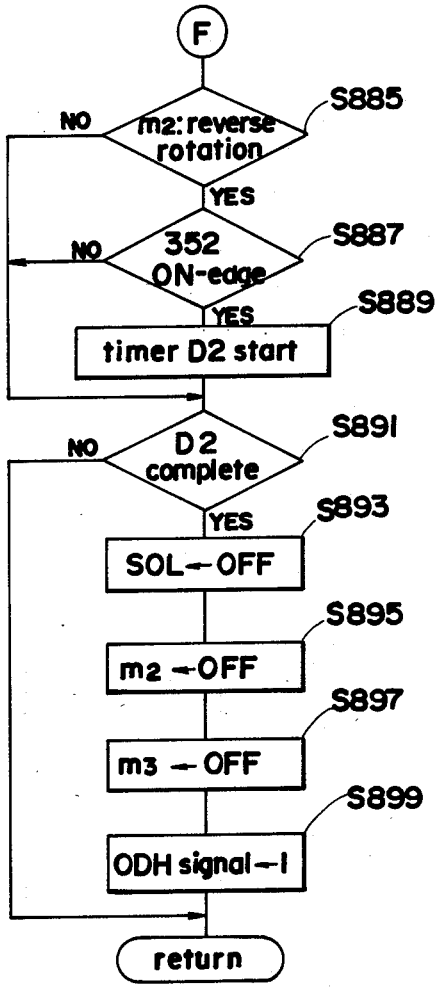

FIGS. 19 and 20 are flow charts showing the document inversion feed routine FEED 2 (S821) in detail. Under the control shown in these charts, the duplex document is fed to the table 8 with its rear surface down first so as to obtain copies in the proper order of pages.

First in steps S861 to S871, the original document on the tray 313 is transported to the inverting unit 303 through the transport unit 302. At this time, the solenoid SOL for driving the change guide 323 for inverting the document is energized when the sensor 351 becomes ON-edge, and the motor m3 for driving the inverting belt 315 for inverting the document in the unit 303 is energized (S863). A timer D1 determines when to turn off the document feed motor ml (S867, S869).

The sensor 352 within the inverting unit 303 detects the leading edge of the document and then the rear end thereof by becoming OFF-edge (indicating that the rear end has been completely placed into this unit). In corresponding relation to the state of the sensor, the flag K is raised and lowered (S873 to S881), whereupon the conveyor belt 319 is reversely driven by the motor m2 (S883). Upon the sensor 352 detecting the leading end of the inverted document, a timer D2 is started (S885 to S889). On completion of the timer operation, the solenoid SOL, the belt motor m2 and the inverting motor m3 are deenergized, and the ODH signal is set to "1" (S391 to S899). The timer D2 determines the time taken for the document leading end to move from the position of the sensor 352 to the specified position on the document support table 8.

Figure 21:
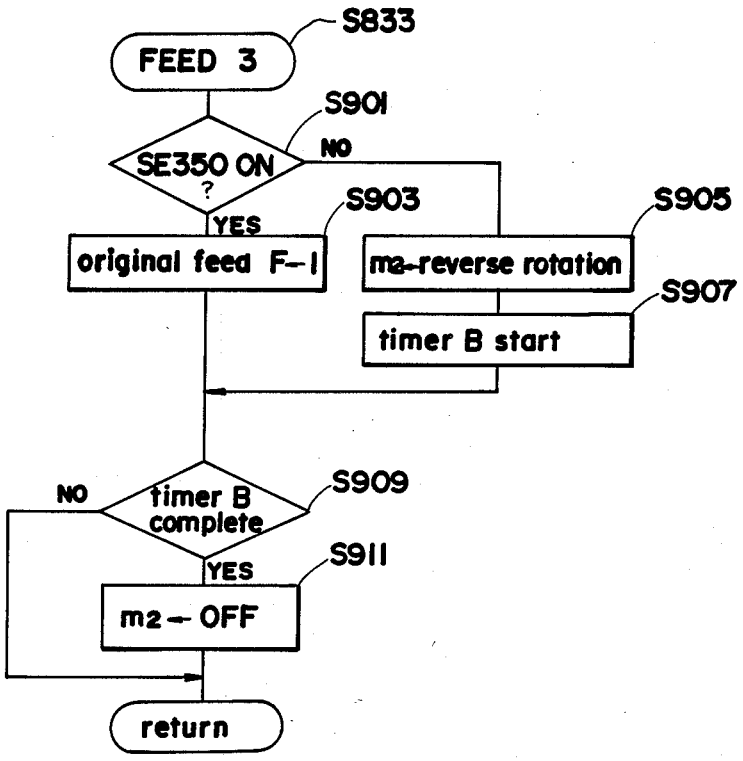

FIG. 21 shows the document discharge routine FEED 3 (S833) in detail.

When the sensor 350 detects another document sheet in the tray 313 for copying (S901), the original feed flag is set to "1" (S903). On the other hand, if the tray 313 is empty, the belt motor m2 is reversely rotated for a period of time set by a timer B to discharge the document from the table 8 to the discharge tray 321 (S905 to S911).

Figure 22:
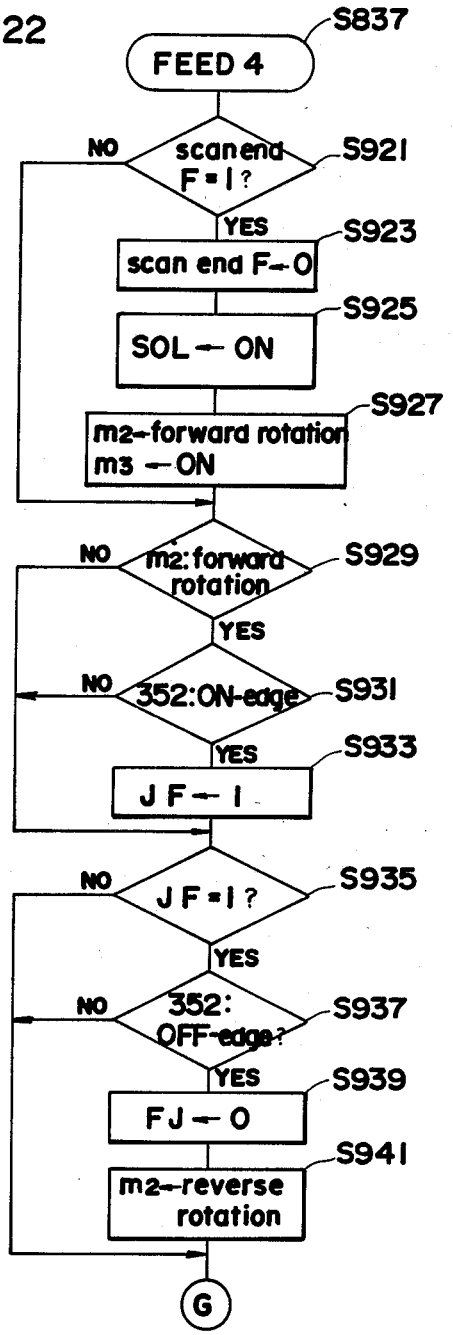
Figure 23:
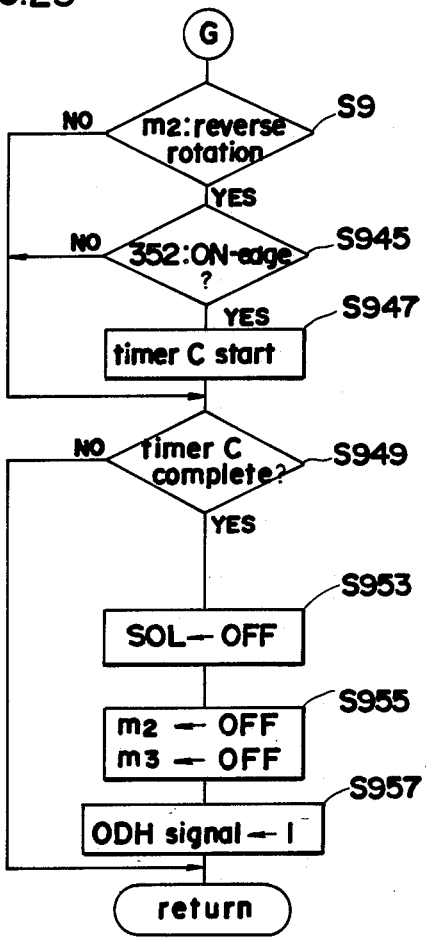

FIGS. 22 and 23 show the document inversion routine FEED 4 (S837) in detail. The document having its rear surface completely copied is turned upside down in the inverting unit 303 for the copying of its front surface by the control process illustrated in these flow charts.

When the scan end flag is "1" as illustrated, i.e. when one surface of the document has been subjected to multicopying operation (S921), the flag is reset to "0" (S923), and the conveyor belt motor m2 is now forwardly driven. With the exception of these steps, the original document is fed generally in the same manner as in steps S863 to S895 so that the other surface will be copied (S929 to S955, a flag J corresponding to the flag K in S875). In this process, the front surface flag is "0" (S951). The ODH signal is thereafter set to "1" (S957).

When the rear surface of a duplex document is to be copied according to the foregoing embodiment, the timer F is set (S547) for specifying an image forming area on the photosensitive drum so as not to form any copy image at the rear end of copy paper (toward the inverting unit 303 of the ADF) with respect to the paper feeding direction over an area corresponding to the binding margin. Further when the front surface of the duplex document is to be copied, the timer G is operated for holding the LEDs of the eraser unit 4 on (S549) so is not to form any copy image at the front end of the copy paper (toward the document support unit 301 of the ADF) over an area corresponding to the binding margin although the LEDs should usually be off at the end of the image forming area. In the duplex-single copy mode, therefore, the opposite surfaces of the document can be copied on different sheets of copy paper individually, with the unnecessary image as of punch holes in the binding margin of each surface erased by an input from the binding margin erasure switch 96 given by the touch of the switch.

Reference to Other Embodiments

With the foregoing embodiment, the image in each binding margin of the duplex document fed by the ADF is eliminated from the copy at a position toward the scale on the document support table (toward the unit 301 of the ADF) when the front surface is copied, and at the opposite side for the rear surface. However, a binding margin position change input key may be additionally provided on the operation panel 9 for use with a flag which is set or reset in accordance with the input of the key to reverse the judgment of step S543. More specifically, when the change indicating flag is set, steps S549 to S551 are performed if the front surface flag is "1" in step S543 or steps S545 to S547 are performed if the front surface flag is "0". Further when the change indicating flag is reset, the same procedure as in the embodiment is executed. In the case where such margin position change key is provided, the position of the binding margin for the erasure of image is alternatively selectable with respect to the feed direction, hence convenient.

Although the timer G is set to a definite value G0 to make the width of erasure for the binding margin constant according to the foregoing embodiment, the width of erasure can be altered. For example, an erasure width varying key may be provided to alter the value G0 for the timer G using this key.

While the values shown for the timers F, G and H in the foregoing embodiment are for use at a magnification of 1X, proper values for use at different magnifications can of course be obtained by multiplying the value at 1X by the altered magnification.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus for copying a duplex original document having binding margins at both sides thereof comprising:

an exposure station for exposing the original to light;

transporting means for positioning the first surface of the original in the exposure station with its one end set in position, turning the original upside down after exposure and positioning the second surface of the original in the exposure station with the other end thereof set in position;

a photosensitive member movable in a predetermined direction;

means for sensitizing the surface of the photosensitive member being moved;

means for projecting the image of the original onto the sensitized surface of the photosensitive member being moved to form an electrostatic latent image corresponding to the original;

means for irradiating the sensitized surface of the photosensitive member with an erasing light;

binding area erasing mode selection means for selecting a binding area erasing mode; and means, operable in the binding area erasing mode, for controlling said irradiating means to irradiate a first area of the surface of the photosensitive member which corresponds to the binding margin of the first surface of the original when the first surface is copied, and to irradiate a second area of the surface of the photosensitive member which correspond to the binding margin of the second surface of the original when the second surface is copied.

2. A copying apparatus as claimed in claim 1, wherein the width of said first area of the surface of the photosensitive member is equal to the width of said second area of the surface of the photosensitive member.

3. A copying apparatus as claimed in claim 2, further comprising means for varying the width of said first and second area.

4. A copying apparatus for copying a duplex original document having binding margins at both sides thereof comprising:

an exposure station for exposing the original to light;

transporting means for positioning the first surface of the original in the exposure station with its one end set in position, turning the original upside down after an exposure and positioning the second surface of the original in the exposure station with the other end thereof set in position;

a photosensitive member movable in a predetermined direction;

means for sensitizing the surface of the photosensitive member being moved;

means for projecting the image of the original onto the sensitized surface of the photosensitive member being moved to form an electrostatic latent image a corresponding to the original;

means for irradiating the sensitized surface of the photosensitive member with an erasing light;

binding area erasing mode selection means for selecting a binding area erasing mode; and means, operable in the binding area erasing mode, for controlling the operating timing of said irradiating member in a first mode when the first surface is copied and in a second mode when the second surface is copied, whereby a prescribed extent of a leading end portion of the electrostatic latent image corresponding to the image of the first surface is erased in the first mode and the same extent of a trailing end portion of the electrostatic latent image corresponding to the second surface is erased in the second mode.

5. A copying apparatus for copying a duplex original document having binding margins at both sides thereof comprising:

an exposure station for exposing the original to light;

transporting means for positioning the first surface of the original in the exposure station with its one end set in position, turning the original upside down after an exposure and positioning the second surface of the original in the exposure station with the other end thereof set in position;

means for forming the image of the original positioned in the exposure station onto an image retentive member which is movable in a predetermined direction;

binding area erasing mode selection means for selecting a binding area erasing mode; and means, operable in the binding area erasing mode, for erasing a prescribed extent of a leading end portion of the image corresponding to the first surface of the original when the first surface is copied and erasing the same extent of a trailing end portion of the image corresponding to the image of the second surface of the original when the second surface is copied.

6. A copying apparatus for copying a duplex original document having binding margins at both sides thereof comprising:

an exposure station for exposing the original to light;

transporting means for positioning the first surface of the original in the exposure station with its one end set in position, turning the original upside down after an exposure and positioning the second surface of the original in the exposure station with the other end thereof set in position;

a photosensitive member movable in a predetermined direction;

means for sensitizing the surface of the photosensitive member being moved;

means for projecting the image of the original onto the sensitized surface of the photosensitive member being moved to form an electrostatic latent image corresponding to the original;

means for irradiating the sensitized surface of the photosensitive member with an erasing light;

means for detecting the size of the original;

means for determining the location of the binding margin of the first side of the original on the exposure station and the location of the binding margin of the second side of the original on the exposure station in accordance with the detecting means;

binding area erasing mode selection means for selecting a binding area erasing mode; and means, operable in the binding area erasing mode, for controlling said irradiating means in accordance with the detected size to irradiate a first area of the surface of the photosensitive member which corresponds to the binding margin of the first surface of the original when the first surface is copied, and to irradiate a second area of the surface of the photosensitive member which corresponds to the binding margin of the second surface of the original when the second surface is copied.

7. A copying apparatus for copying a duplex original document having binding margins at both sides thereof comprising:

an exposure station for exposing the original to light;

transporting means for positioning the first surface of the original in the exposure station with its one end set in position, turning the original upside down after an exposure and positioning the second surface of the original in the exposure station with the other end thereof set in position;

a photosensitive member movable in a predetermined direction;

means for sensitizing the surface of the photosensitive member being moved;

means for projecting the image of the original onto the sensitized surface of the photosensitive member being moved to form an electrostatic latent image corresponding to the original;

means for irradiating the sensitized surface of the photosensitive member with an erasing light;

binding area erasing mode selection means for selecting a binding area erasing mode; and means for detecting the size of the original;

means for determining the location of the binding margin on the first side of the original on the exposure station and the location of the binding margin on the second side of the original on the exposure station in accordance with the detecting means;

means, operable in the binding area erasing mode, for controlling the operable timing of said irradiating member in a first mode when the first surface is copied and in a second mode when the second surface is copied in accordance with the detected size, whereby a prescribed extent of a leading end portion of the electrostatic latent image corresponding to the image of the first surface is erased in the first mode and the same extent of a trailing end portion of the electrostatic latent image corresponding to the second surface is erased in the second mode.

8. A copying apparatus for copying a duplex original document having binding margins at both sides thereof comprising:

an exposure station for exposing the original to light;

transporting means for positioning the first surface of the original in the exposure station with its one end set in position, turning the original upside down after an exposure and positioning the second surface of the original in the exposure station with the other end thereof set in position;

means for forming the image of the original positioned in the exposure station onto an image retentive member which is movable in a predetermined direction;

means for detecting the size of the original;

means for determining the location of the binding margin of the first side of the original on the exposure position and the location on the binding margin of the second side of the original on the exposure station in accordance with the detecting means;

binding area erasing mode selection means for selecting a binding area erasing mode; and means, operable in the binding area erasing mode, for erasing a prescribed extent of a leading end portion of the image corresponding to the first surface of the original when the first surface is copied and erasing the same extent of a trailing end portion of the image corresponding to the image of the second surface of the original when the second surface is copied in accordance with tee detected size.

9. In a copy apparatus for copying a duplex original document having binding margins at both sides thereof comprising an exposure station for exposing the original to light, transporting means for positioning the first surface of the original in the exposure station with its one end set in position, turning the original upside down after an exposure and positioning the second surface of the original in the exposure station with the other end thereof set in position, a photosensitive member movable in a predetermined direction, means for sensitizing the surface of the photosensitive member being moved, means for projecting the image of the original onto the sensitized surface of the photosensitive member being moved to form an electrostatic latent image corresponding to the original, means for irradiating the sensitized surface of the photosensitive member with an erasing light and means for detecting the size of the original, a method for controlling the apparatus comprising the steps of:

detecting the size of the original;

determining the location of the binding margin of the first side of the original on the exposure station and the location of the binding margin of the second side of the original on the exposure station in accordance with the detecting means; and irradiating a first area of the surface of the photosensitive member which corresponds to the binding margin of the first surface of the original when the first surface is copied, and irradiating a second area of the surface of the photosensitive member which corresponds to the binding margin of the second surface of the original when the second surface is copied.

* * * * *